US005971194A

United States Patent [19]

Freedland

[11] Patent Number: 5,971,194

[45] **Date of Patent: *Oct. 26, 1999**

[54] LINER CONCEALING TRASH RECEPTACLE

[76] Inventor: Darryle Freedland, 20110 NE. 23rd Ct., N. Miami Beach, Fla. 33180

[ * ] Notice: This patent issued on a continued prosecution application filed under 37 CFR 1.53(d), and is subject to the twenty year patent term provisions of 35 U.S.C. 154(a)(2).

This patent is subject to a terminal disclaimer.

[21] Appl. No.: 08/891,874

[22] Filed: Jul. 9, 1997

Related U.S. Application Data

[63] Continuation of application No. 08/653,779, May 28, 1996, abandoned.

[51] Int. Cl.[6] ..... B65F 1/06; B65F 1/16

[52] U.S. Cl. ..... 220/495.08; 220/495.11; 220/798; 220/908.3

[58] Field of Search ..... 220/404, 403, 220/402, 400, 407, 733, 908, 909, 495.08, 495.11, 495.09, 495.06, 797, 798, 908.1, 908.3

[56] References Cited

U.S. PATENT DOCUMENTS

| | | | |
|---|---|---|---|
| Re. 29,898 | 2/1979 | Wheeler . | |
| D. 299,773 | 7/1989 | Kracke . | |
| D. 315,625 | 3/1991 | Hallinan et al. . | |
| D. 328,510 | 8/1992 | Brussing . | |
| D. 343,709 | 1/1994 | Doty et al. . | |
| 606,838 | 5/1898 | Heins . | |
| 3,818,956 | 6/1974 | Chamberlain . | |
| 3,964,630 | 6/1976 | Getz | 220/404 |
| 4,228,916 | 10/1980 | Weingardt . | |
| 4,449,984 | 5/1984 | Cruz . | |
| 4,466,553 | 8/1984 | Zenger . | |
| 4,715,572 | 12/1987 | Robbins, III et al. . | |
| 4,765,579 | 8/1988 | Robbins, III et al. . | |
| 4,834,261 | 5/1989 | Brdlik . | |
| 4,905,853 | 3/1990 | Strawder | 220/495.09 X |
| 4,913,308 | 4/1990 | Culbertson . | |
| 4,955,497 | 9/1990 | Winden et al. . | |
| 5,005,727 | 4/1991 | Roth . | |
| 5,065,891 | 11/1991 | Casey | 220/404 |
| 5,119,960 | 6/1992 | Robbins, III . | |
| 5,160,063 | 11/1992 | Bailey | 220/404 |
| 5,363,979 | 11/1994 | Thorso | 220/404 |
| 5,385,259 | 1/1995 | Bernstein et al. | 220/404 |
| 5,425,469 | 6/1995 | Freedland | 220/404 |
| 5,476,187 | 12/1995 | Marisco | 220/404 |
| 5,535,913 | 7/1996 | Asbach et al. | 220/404 |

*Primary Examiner*—Stephen Castellano
*Assistant Examiner*—Niki M. Eloshway
*Attorney, Agent, or Firm*—Sixbey Friedman Leedom & Ferguson; Thomas W. Cole

[57] ABSTRACT

A trash receptacle that both secures and conceals a plastic liner is provided that comprises a receptacle body having sidewalls that terminate in an open end, a receptacle flange having one end secured around the sidewalls of the receptacle body, and a free edge for supporting a portion of the open end of the liner that has been folded over the free edge, and a lid that both secures and covers the folded-over portion of the liner. The lid includes an upper portion having a trash receiving opening, a liner engaging portion for frictionally engaging the liner between the free edge of the receptacle flange and the lid, and a lid flange that frictionally interfits with the open end of the receptacle body to secure the lid in place. Alternatively, the flange may be removable from the receptacle and complementary in shape to the inner edge of the receptacle so that the open end of the liner is secured between the flange and the receptacle.

7 Claims, 3 Drawing Sheets

LINER CONCEALING TRASH RECEPTACLE

This application is a Continuation of Ser. No. 08/653,779; filed May 28, 1996, now abandoned.

BACKGROUND OF THE INVENTION

This application generally relates to trash receptacles, and is specifically concerned with a liner concealing and securing trash receptacle.

Trash receptacles lined with plastic-bag type liners are not only well known in the prior art, but are in use in practically every home and office in the United States. The use of such liners in trash receptacles not only insulates the interior walls of the receptacle from liquids and sticky substances (which would necessitate frequent cleaning of the receptacles), but further provides a convenient way to empty the trash from such receptacles. To accommodate the wide variety of sizes and shapes of home, office, and commercial trash receptacles, plastic liners of all different sizes are presently available. Such liners are typically formed from thin, water impermeable plastic sheet material that has been formed into a tube having a closed end and an open end. In use, the open end of the liner is spread apart to allow air to enter its interior, whereupon it is placed into the interior of a trash receptacle. The top portion of the liner is then folded over the upper edge of the trash receptacle. In many instances, the diameter of the plastic liner is chosen to be slightly smaller than the outer diameter of the top of the trash receptacle so that the user must apply some amount of tension to the open end of the liner in order to fold a portion of the open end over the top portion of the receptacle. The tension thus generated by the upper portion of the liner advantageously helps to secure it in position around the open end of the receptacle.

While the folding over of the liner over the open end of the receptacle provides an easy, convenient, and inexpensive way to position the liner within the receptacle, the applicant has observed two major shortcomings associated with the resulting lined receptacles. First, if the diameter of the open end of the liner is the same size or larger than the outer diameter of the upper end of the receptacle, the folding over of the top end of the liner may not adequately secure it to the trash receptacle since there is no tension between the folded-over portion of the bag and the receptacle. Accordingly, as the receptacle is filled with trash, the upper end of the liner may easily be pulled away from its folded-over position. Once this happens, liquid or gummy substances thrown into the receptacle can become lodged between the outer surface of the liner and the inner walls of the receptacle, thereby necessitating the cleaning of the receptacle. Secondly, the folded-over portion of such plastic liners is unsightly, even when they are formed from translucent or transparent plastic materials. Thus much of the aesthetic effort spent by the designers and manufacturers of trash receptacles is negated by the broad fringe of ugly plastic material that overhangs the upper ends of these receptacles when they are lined with plastic trash bags.

Clearly, what is needed is a trash receptacle which is capable of positively securing and concealing a plastic bag-type liner disposed within its interior. Ideally, such a receptacle would make not only the liner itself, but also the trash disposed within it as unobtrusive as possible. Finally, such a receptacle should be simple to manufacture, compatible with the use of plastic liners of broadly varying dimensions, and aesthetically attractive.

SUMMARY OF THE INVENTION

Generally speaking, the invention is a liner securing and concealing trash receptacle that overcomes all of the aforementioned shortcomings associated with the prior art. The trash receptacle of the invention comprises a receptacle body having an open end, and side and bottom walls for supporting a liner, and a means for both securing and concealing the open upper portion of the liner over the open end of the receptacle body. The securing and concealing means includes a receptacle flange having one end secured around the sidewalls of the receptacle body, and a free edge for supporting a folded-over portion of the open end of the liner, and a lid that fits over the receptacle flange for both securing and concealing the folded-over portion of the liner. To this end, the lid includes an upper portion having a trash receiving opening, and a liner engaging portion for frictionally engaging the liner between the free edge of the flange and the lid. The lid also includes a lower portion that includes a securing flange that frictionally interfits with the open end of the receptacle body to secure the lid in place.

Plastic liners of a variety of different sizes are effectively secured and concealed when the securing flange of the lid is slid over the open end of the receptacle in frictional engagement. A bayonet-type locking mechanism may be included on the lid flange to enhance the attachment between the lid and the receptacle. Additionally, the diameter of the trash receiving opening in the lid is smaller than the outer diameter of the lid in order to further conceal not only the liner, but the trash contained within the receptacle.

In the alternate embodiment, the receptacle flange is hoop-like, and removable from the receptacle body, and the lid is eliminated. The open end of the plastic liner is dimensioned slightly smaller than the flange so that it may be stretched thereover in order to keep the liner in place. The hoop-like flange fits flushly around the inner diameter of the receptacle body to further secure the liner in place. This alternate embodiment of the invention effectively conceals the liner edge with a minimum amount of structural complexity.

BRIEF DESCRIPTION OF THE SEVERAL FIGURES

DETAILED DESCRIPTION OF THE PREFERRED EMBODIMENT

Figure 1:
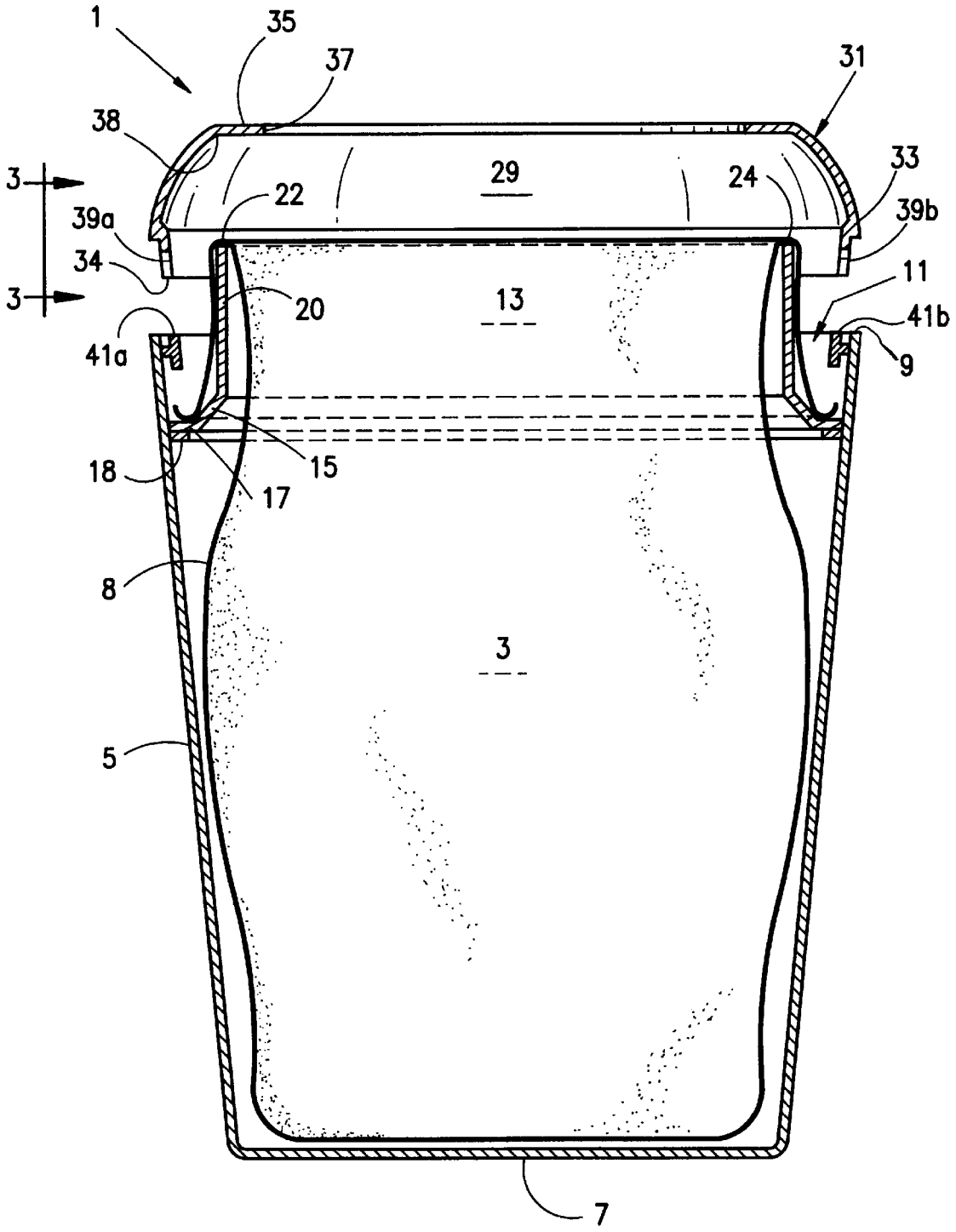
FIG. 1 is a side, cross-sectional exploded view of the trash receptacle of the invention with a liner installed in the interior of the receptacle body.
Figure 2:
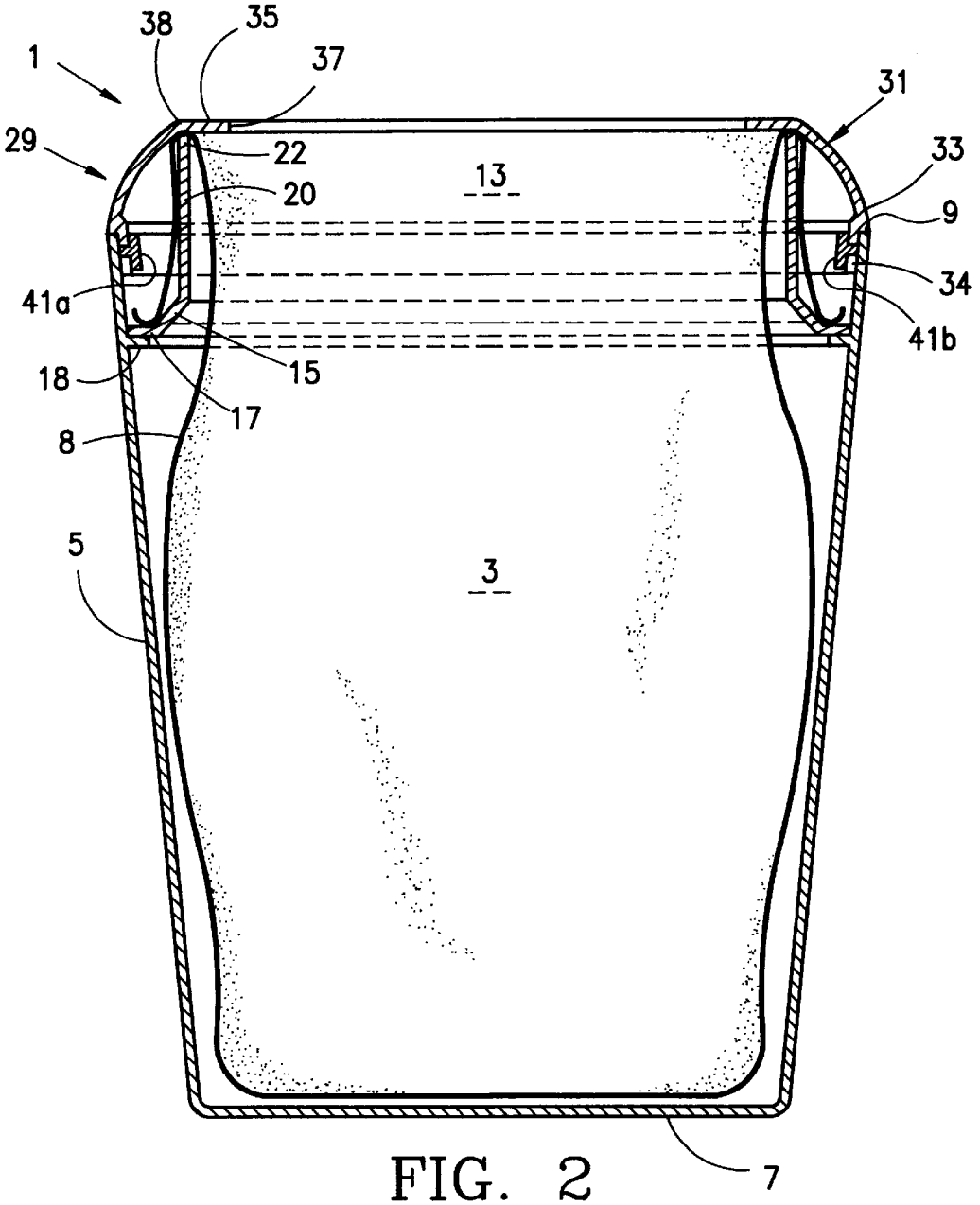
FIG. 2 is the trash receptacle of FIG. 1 shown in assembled form.

With reference now to FIGS. 1 and 2, the trash receptacle 1 of the invention includes a receptacle body 3 having tubular sidewalls 5. A circular bottom wall 7 is integrally formed around the bottom edge of the tubular sidewalls 5. The sidewalls 5 and bottom wall 7 may be integrally formed together from a resilient polymeric material. As will be described in detail hereinafter, the interior of the sidewalls 5 and bottom wall 7 may be lined with a tubular plastic liner 8 having a closed bottom end and an open top end. The top of the tubular sidewalls 5 terminates in an annular top edge 9 which defines an open end 11 of the receptacle body 3.

Extending upwardly over the annular top edge 9 of the receptacle body 3 is a receptacle flange 13. The flange 13 includes a lower, frustro-conical portion 15. The lower end 17 of the frustro-conical portion 15 may be secured to an annular support ledge 18 by glue or the like or may merely rest on support ledge 18 so as to be removable from the receptacle body 3. The upper portion 20 of the receptacle flange 13 terminates in a free edge 22. Free edge 22 supports a folded-over portion 24 of the plastic liner 8.

Figure 3:
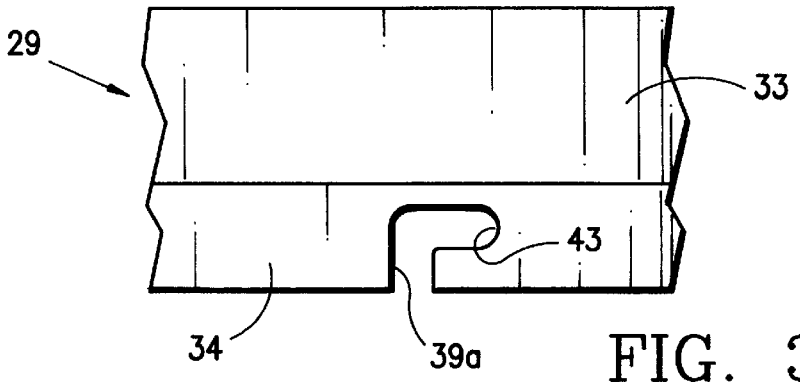
FIG. 3 is an enlarged view of FIG. 1 along the line 3—3.

Trash receptacle 1 further includes a lid 29 having an upper annular portion 31 that includes outer sidewalls 33. Sidewalls 33 preferably of the same diameter as the tubular sidewalls 5 of the receptacle body 3. The lid sidewalls 33 terminate in a lid flange 34 that frictionally interfits around the inner diameter of the top of the tubular sidewalls 5 when the receptacle 1 is assembled in the form illustrated in FIG. 2. The top of the lid 29 includes a circular top wall 35 having a circular trash receiving opening 37. Lid 29 further includes a liner retaining portion 38 disposed at the junction between the circular top wall 35 and the sidewalls 33 that helps to retain the plastic liner 8 in place within the receptacle 1 in a manner that will be described presently. Finally, as is best seen in FIGS. 1 and 3, the lid flange 34 includes a pair of opposing bayonet slots 39*a,b* for receiving a pair of opposing bayonet studs 41*a,b* secured on the inner edge of the top portion of the tubular sidewalls 5.

In operation, a plastic liner 8 is placed in the receptacle body 3 in the position illustrated in FIG. 1 with the lid 29 removed from the receptacle body. Next, the lid 29 is secured onto the upper edge of the tubular sidewalls 5 of the receptacle body 3 by aligning the bayonet slots 39*a,b* with the bayonet studs 41*a,b* and pressing the lid 29 downwardly so that the lid flange 34 frictionally engages the inner edge of the open end 11 of the tubular sidewalls 5. Finally, the lid 29 is twisted so that the bayonet studs 41*a,b* are disposed within the terminal portion 43 (shown in FIG. 3) of each of the slots 39*a,b*. When the lid 29 is thus secured over the receptacle body 3, the folded-over portion 34 of the liner 8 is pinched between the liner retaining portion 38 of the lid 29, and the free edge 22 of the receptacle flange 13, thereby preventing the liner 8 from being pulled out from around the flange 13 when trash or other objects are placed within the receptacle 1.

Figure 4:
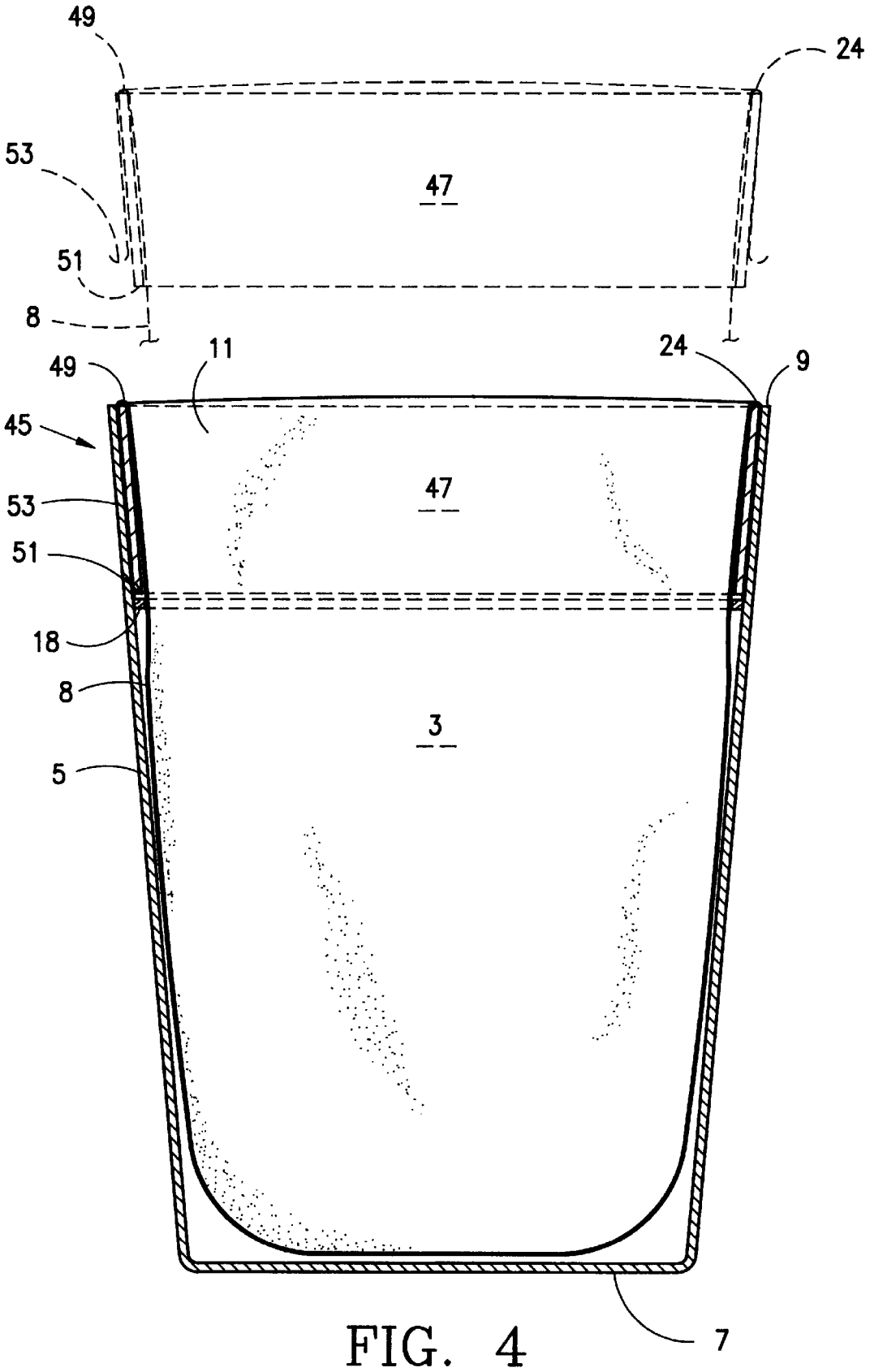
FIG. 4 is a side, cross-sectional view of an alternate embodiment of the invention.

FIG. 4 illustrates an alternative embodiment 45 of the invention which utilizes a hoop-like flange 47 that is removable from the receptacle body 3. The hoop-like flange 47 includes an upper edge 49 that the liner 8 folds over, and a lower edge 51 that rests on the top of the annular ledge 18 when the flange 47 is inserted into the receptacle body 3. Unlike the previously-described receptacle flange 13, the outer diameter of the hoop-like flange 47 is complementary in shape to the inner diameter of the upper portion of the receptacle body so that there is no space between these two components when the flange 47 is inserted into the receptacle body 3. Additionally, the top edge of the sidewalls 5 of the receptacle body 3 are dimensioned so that they are level with or slightly higher than the upper edge 49 of the hoop-like flange 47. Further unlike the previously-described embodiment 1, this alternative embodiment 45 dispenses entirely with the lid 29.

In operation, the hoop-like flange 47 is pulled out of the receptacle body 3 in the position illustrated in phantom. Preferably, the upper edge 53 of the liner 8 is dimensioned to be slightly smaller in diameter than the upper edge 49 of the flange 47 so that the edge 53 "hugs" the outer diameter of the flange 47 when pulled over it as shown. Once the liner 8 has been thus secured around the flange 47, flange 47 is pushed down from the position illustrated in phantom to the position illustrated in solid lines in FIG. 4. Thus seated, the top edge 53 of the liner 8 is further captured and secured between the inner diameter of the tubular sidewalls 5 of the receptacle body 3, and the outer diameter of the hoop-like flange 47. The frustro-conical shape of the hoop-like flange 47 advantageously wedges the top edge 53 of the liner 8 between the flange 47 and the tubular sidewalls 5 of the receptacle 3 when the bottom edge 53 of the flange is seated against the upper surface of the annular ledge 18.

Although this invention has been described with respect to two preferred embodiments, various modifications, variations, and additions to the invention will become evident to persons skilled in the art. All such modifications, variations, and additions are intended to be encompassed within the scope of this invention, which is limited only by the claims appended hereto.

What is claimed:

1. A trash receptacle having means for supporting, securing, and concealing a liner, comprising:

(a) a receptacle body having an open end, side walls and a bottom wall for supporting a liner having an open end defined by an upper edge, and (b) means for securing and concealing an open upper portion of a liner, including:

(i) a receptacle flange having an upper portion terminating in a free edge which extends a vertical distance over said open end of said receptacle body for supporting a portion of an open end of a liner that has been folded over said free edge such that the upper edge of said liner surrounds an outer surface of said flange, and a lower portion terminating in an end that is supported around an inner surface of said side walls below the open end of the receptacle body for spacing said flange away from said receptacle side walls such that a groove is formed between said lower portion of said flange and said inner surface of said side walls for receiving and concealing said upper edge of said liner, and (ii) a lid for covering and concealing said upper edge of said liner, including an upper portion that includes an opening for receiving trash, an annular portion for frictionally engaging said liner between said lid and said free edge of said receptacle flange, and a lid flange extending downwardly from said upper portion that is frictionally engageable with the open end of the receptacle body, said lid flange being spaced apart from said receptacle flange and said upper edge of said liner such that no contact occurs between said lid flange and said liner edge.

2. The trash receptacle defined in claim 1, wherein said groove defines a cavity for containing and concealing said liner edge after said lid flange is engaged with the open end of the receptacle body.

3. The trash receptacle defined in claim 1, wherein said annular portion of said lid engages the free edge of the upper portion of the receptacle flange when said lid flange is engaged with the open end of the receptacle body such that the open end of a liner that has been folded over said receptacle flange is pinched between said annular portion of said lid and the free edge of the receptacle flange.

4. The trash receptacle defined in claim 1, wherein said annular portion of said lid that engages said folded over portion of said liner is vertically spaced apart from said lid flange.

5. The trash receptacle defined in claim 1, wherein the trash receiving opening in said lid is oriented along a plane that is transverse with respect to said side walls of said receptacle body.

6. The trash receptacle defined in claim 5, wherein said trash receiving opening is circular, and smaller than an outer diameter of said lid to conceal said liner.

7. A trash receptacle having means for supporting, securing, and concealing a liner, comprising:

(a) a receptacle body having an open end, side walls and a bottom wall for supporting a liner having an open end defined by an upper edge, and (b) means for securing and concealing an upper portion of a liner, including a receptacle flange having an upper portion terminating in a free edge that extends a vertical distance over said open end of said receptacle body for supporting a portion of an open end of a liner that has been folded over said free edge such that the upper edge of the liner surrounds an outer surface of the flange, and a lower portion terminating in an end that is supported around an inner surface of said side walls for spacing said flange away from said receptacle side walls such that a liner-receiving cavity is formed between said flange and said side walls, and (c) a lid for covering and concealing said upper edge of said liner, including an upper portion having an opening for receiving trash, an annular portion for frictionally engaging said liner between said lid and said free edge of said receptacle flange, and a lid flange extending downwardly from said upper portion that is frictionally engaged with the open end of the receptacle body;

wherein said receptacle flange is insertable into and removable from the open end of the receptacle body.

* * * * *